US010781083B2

(12) United States Patent
Kuhn et al.

(10) Patent No.: US 10,781,083 B2
(45) Date of Patent: Sep. 22, 2020

(54) MOBILE CRANE AND METHOD FOR ANGLING A MAIN BOOM EXTENSION IN RELATION TO A MAIN BOOM OF A MOBILE CRANE

(71) Applicant: Terex Global GmbH, Schaffhausen (CH)

(72) Inventors: Roland Kuhn, St. Ingbert (DE); Michael Martin, Illingen (DE)

(73) Assignee: Terex Global GmbH, Schaffhausen (CH)

( * ) Notice: Subject to any disclaimer, the term of this patent is extended or adjusted under 35 U.S.C. 154(b) by 0 days.

(21) Appl. No.: 15/778,124

(22) PCT Filed: Nov. 22, 2016

(86) PCT No.: PCT/EP2016/078467

§ 371 (c)(1),
(2) Date: May 22, 2018

(87) PCT Pub. No.: WO2017/089356

PCT Pub. Date: Jun. 1, 2017

(65) Prior Publication Data

US 2018/0346292 A1 Dec. 6, 2018

(30) Foreign Application Priority Data

Nov. 24, 2015 (DE) ..... 10 2015 120 350

(51) Int. Cl.
*B66C 23/70* (2006.01)
*B66C 23/68* (2006.01)
(Continued)

(52) U.S. Cl.
CPC ..... *B66C 23/702* (2013.01); *B66C 23/06* (2013.01); *B66C 23/42* (2013.01); *B66C 23/68* (2013.01); *B66C 23/82* (2013.01)

(58) Field of Classification Search
CPC ..... B66C 23/68; B66C 23/701; B66C 23/702; B66C 23/06; B66C 23/42; B66C 23/82; B66C 23/70
See application file for complete search history.

(56) References Cited

U.S. PATENT DOCUMENTS 3,085,695 A * 4/1963 Miller ..... B66C 23/70 212/177
4,394,941 A 7/1983 Privat
(Continued)

FOREIGN PATENT DOCUMENTS

CN 1138005 A 12/1996
CN 2364010 Y 2/2000
(Continued)

OTHER PUBLICATIONS

Preliminary Report on Patentability of the International Searching Authority in English from corresponding Patent Cooperation Treaty (PCT) Application No. PCT/EP2016/078467, completed Feb. 26, 2018.

(Continued)

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A mobile crane comprising a main boom, which is supported on the mobile crane in such a way that the main boom can be rocked and which can be put upright by means of an elevating cylinder, and a main boom extension, which is releasably connected to a main boom head of the main boom by upper and lower pins. The main boom extension, proceeding from a home position, can be angled in relation to the main boom about a rocking axis by means of an angle drive after the upper pins have been released, which angle drive acts on a base of the main boom extension, where a (Continued)

drive of the mobile crane provided for a different task provides the kinetic energy for the angle drive. The angle drive is designed in such that a telescoping cylinder of the main boom provides the kinetic energy for the angle drive.

19 Claims, 7 Drawing Sheets

(51) Int. Cl.

| | |
|---|---|
| ***B66C 23/06*** | (2006.01) |
| ***B66C 23/42*** | (2006.01) |
| ***B66C 23/82*** | (2006.01) |

(56) References Cited

U.S. PATENT DOCUMENTS

| | | | | |
|---|---|---|---|---|
| 4,653,655 | A * | 3/1987 | Rathi | B66C 23/702 212/177 |
| 4,828,124 | A | 5/1989 | Iga | |
| 5,842,587 | A * | 12/1998 | Wanek | B66C 23/82 212/177 |
| 9,056,752 | B2 | 6/2015 | Müller et al. | |
| 9,090,436 | B2 | 7/2015 | Franzen et al. | |
| 9,272,883 | B2 | 3/2016 | Behnke | |
| 2005/0011850 | A1* | 1/2005 | Hinrichs | B66C 23/702 212/300 |
| 2005/0098524 | A1* | 5/2005 | Irsch | B66C 13/18 212/300 |
| 2010/0213152 | A1* | 8/2010 | Martin | B66C 23/18 212/177 |
| 2010/0294738 | A1* | 11/2010 | Martin | B66C 23/344 212/347 |
| 2010/0329773 | A1* | 12/2010 | Martin | B66C 23/702 403/3 |
| 2017/0066632 | A1 | 3/2017 | Hegewald | |
| 2018/0044149 | A1 | 2/2018 | Weckbecker et al. | |
| 2018/0327234 | A1 | 11/2018 | Martin et al. | |
| 2018/0339889 | A1 | 11/2018 | Kuhn et al. | |
| 2018/0346291 | A1 | 12/2018 | Martin et al. | |

FOREIGN PATENT DOCUMENTS

| | | | |
|---|---|---|---|
| CN | 101628691 | A | 1/2010 |
| CN | 101687618 | A | 3/2010 |
| CN | 201458603 | U | 5/2010 |
| CN | 101830403 | A | 9/2010 |
| CN | 102862921 | A | 1/2013 |
| CN | 103359636 | A | 10/2013 |
| CN | 102602825 | B | 7/2014 |
| DE | 291531 | A5 | 7/1991 |
| DE | 202004020760 | U1 | 3/2006 |
| DE | 10321493 | B4 | 7/2006 |
| DE | 102009010452 | A1 | 9/2010 |
| DE | 102012023814 | A1 | 6/2014 |
| DE | 102014003831 | A1 | 9/2015 |
| EP | 1081088 | A1 | 3/2001 |
| EP | 2253576 | A1 | 11/2010 |
| FR | 2075866 | A1 | 10/1971 |
| FR | 2719574 | A1 | 11/1995 |
| GB | 1470488 | A | 4/1977 |
| GB | 2081210 | A | 2/1982 |
| JP | S60100390 | U | 7/1985 |
| JP | S6346465 | Y2 | 12/1988 |
| JP | H09104588 | A | 4/1997 |

OTHER PUBLICATIONS

International Search Report of the International Searching Authority from corresponding Patent Cooperation Treaty (PCT) Application No. PCT/EP2016/078467, indicated completed on Feb. 22, 2017.

Written Opinion of the International Searching Authority from corresponding Patent Cooperation Treaty (PCT) Application No. PCT/EP2016/078467, indicated completed on Feb. 22, 2017.

International Preliminary Examination Report from corresponding Patent Cooperation Treaty (PCT) Application No. PCT/EP20161078467, dated Oct. 24, 2017.

* cited by examiner

MOBILE CRANE AND METHOD FOR ANGLING A MAIN BOOM EXTENSION IN RELATION TO A MAIN BOOM OF A MOBILE CRANE

The present application claims the priority benefits of International Patent Application No. PCT/EP2016/078467, filed Nov. 22, 2016, and claims benefit of German patent application DE 10 2015 120 350.2, filed Nov. 24, 2015.

BACKGROUND OF THE INVENTION

The invention relates to a mobile crane with a main jib luffably mounted thereon and able to be raised via a luffing cylinder, and with a main jib extension releasably connected to a main jib head of the main jib via upper bolts and lower bolts, the main jib extension, starting from a basic position after release of the upper bolts, is able to be angled about a luffing axis relative to the main jib by means of an angling drive, the angling drive engages on a foot of the main jib extension, wherein a drive of the mobile crane, which is provided for another task, provides the movement energy for the angling drive.

The invention also relates to a method for angling a main jib extension relative to a main jib of a mobile crane, wherein the main jib is luffably mounted on the mobile crane and can be raised via a luffing cylinder, the main jib extension is releasably connected to a main jib head of the main jib via upper bolts and lower bolts, an angling drive engages on a foot of the main jib extension, wherein by means of the angling drive which, for the angling procedure, draws its movement energy from a drive of the mobile crane which is otherwise provided for another task of the mobile crane, the main jib extension, starting from a basic position is raised about a luffing axis relative to the main jib until the upper bolts are relieved, then the upper bolts are removed.

German utility model DE 20 2004 020 760 U1 already discloses a mobile crane with a main jib and a main jib extension fastened to its main jib head. The main jib extension is luffable from a basic position, in which the main jib extension is orientated with its longitudinal direction as an extension of the longitudinal direction of the main jib, into a 20° position and a 40° position. In a conventional manner, the main jib extension is releasably fastened to the main jib head via two lower bolts disposed in the region of bottom chords of the main jib extension and two upper bolts disposed in the region of top chords of the main jib extension. In order to be able to luff the main jib extension about the two lower bolts serving as a luffing axis out of the basic position, in a first step the two upper bolts are pulled and in a second step, by means of hydraulic luffing cylinders which engage on the main jib head and on the main jib extension, the luffing of the main jib extension is effected. The insertion and pulling of the two upper bolts is effected in each case via a hydraulic bolting cylinder. In order to power the luffing cylinders and the bolting cylinders an autonomous hydraulic assembly is disposed at the lower end of the main jib extension. It is possible to use e.g. a diesel engine or an electric motor, in each case with an associated hydraulic pump, as the hydraulic assembly.

SUMMARY OF THE INVENTION

The object of the invention is to create a mobile crane and a method for angling a main jib extension relative to a main jib of a mobile crane, with which the angling of the main jib extension is simplified.

In accordance with the invention, in the case of a mobile crane with a main jib luffably mounted thereon and able to be raised via a luffing cylinder, and with a main jib extension releasably connected to a main jib head of the main jib via upper bolts and lower bolts, wherein the main jib extension, starting from a basic position after release of the upper bolts, is able to be angled about a luffing axis relative to the main jib by means of an angling drive, the angling drive engages on a foot of the main jib extension, wherein a drive of the mobile crane, which is provided for another task, provides the movement energy for the angling drive, a simplification is achieved by virtue of the fact that the angling drive is designed such that a telescopic cylinder provides the movement energy for the angling drive by retracting and extending the main jib. This ensures that the angling procedure is not performed by means of external auxiliary means or additional auxiliary cylinders but instead drives are used which are provided on the mobile crane and are already present. The angling procedure is not performed by means of hydraulic cylinders which are to be additionally provided. The angling per se takes place predominantly on the ground or the deposit position of the main jib so that it is not necessary to work far above the upper edge of the mobile crane. The invention makes it possible to angle the main jib extension in the case of a mobile crane standing on even ground and with a horizontally orientated telescopic jib. The last part of the luffing-up of the main jib extension to a 20° or a 40° position is assisted by the luffing cylinder of the main jib.

In this case, provision is made that the angling drive engages the main jib on the one hand and engages the main jib extension in the region of its top chord on the other hand. Moreover, the angling drive is advantageously designed in such a way that the main jib extension can be raised and lowered so as to pivot about the luffing axis against the effect of the gravitational force of the main jib extension. In particular, in this case the luffing axis is formed by a lower rolling head spindle.

In one advantageous variant, provision is made that the angling drive comprises a coupling rod, the coupling rod is fastened at a first coupling rod end to the top chord of the main jib extension and is fastened at a second coupling rod end to the main jib, the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

In accordance with the invention, in the case of a method for angling a main jib extension relative to a main jib of a mobile crane, wherein the main jib is luffably mounted on the mobile crane and can be raised via a luffing cylinder, the main jib extension is releasably connected to a main jib head of the main jib via upper bolts and lower bolts, an angling drive engages on a foot of the main jib extension, wherein by means of the angling drive which, for the angling procedure, draws its movement energy from a drive of the mobile crane which is otherwise provided for another task of the mobile crane, the main jib extension, starting from a basic position, is raised about a luffing axis relative to the main jib until the upper bolts are relieved, then the upper bolts are removed, a simplification is achieved by virtue of the fact that angling plates are inserted, or have been inserted, between the main jib head and a top chord of the main jib extension, by means of which angling plates desired angling of the main jib extension with respect the main jib is limited, the main jib extension is lowered by means of the angling drive for as long as until the maximum angling position is reached or a tip of the main jib extension comes to rest on a ground, the drive of the mobile crane is disconnected from the angling drive and if the maximum angling position is not yet reached, the main jib is raised in order to angle the main jib extension until the desired angling is achieved and in order to provide the movement energy a coupling rod is connected to the main jib and the main jib extension and the movement energy is provided by retracting and extending the main jib. In relation to the advantages associated herewith, reference is made to the statements previously given for the mobile crane.

In association with the present invention, a mobile crane is understood to be both a movable telescopic crane and also a movable crawler crane with a lattice mast jib.

The invention is explained in more detail hereinunder with the aid of an exemplified embodiment illustrated in the drawings.

DESCRIPTION OF THE PREFERRED EMBODIMENTS

FIG. 1 shows a side view of a main jib with a main jib extension in a basic position;

FIG. 2*a* shows a side view of an angling plate in a 40° position;

FIG. 2*b* shows a sectional view of FIG. 2*a;*

FIG. 2*c* shows a plan view of an angling plate in a transport position;

FIG. 2*d* shows a sectional view of FIG. 2*c;*

FIG. 2*e* shows a side view of an angling plate in a 20° position;

FIG. 3 shows the main jib of FIG. 1 with the main jib extension in a 20° position;

FIG. 4 shows the main jib of FIG. 1 with the main jib extension in a 40° position;

FIG. 5 shows a detailed view of FIG. 4 with an angling plate in a stop position;

FIG. 6 shows a detailed view from the region where the main jib extension is coupled to the main jib and a coupling rod for angling purposes; and FIG. 7 shows a view as in FIG. 6 in another position of the main jib extension.

BRIEF DESCRIPTION OF THE DRAWINGS

FIG. 1 shows the main jib 1 in a so-called stored position in which the main jib 1 is oriented with its longitudinal direction substantially horizontal. The main jib 1 is designed as a telescopic jib comprising a basic box 1*b* and telescopic sections 1*d* guided therein and has, on its end facing away from the base frame 2 of the superstructure, a main jib head 1*b* and therefore on the innermost telescopic section 1*d*. The telescopic jib can be extended and retracted in a typical manner by means of a telescopic cylinder 1*e*, not illustrated in FIG. 1, arranged in the innermost telescopic section 1*d*. An extension of the main jib 1 in the form of a main jib extension 4 is releasably fastened to the main jib head 1*b*. The main jib extension 4 can be used temporarily or continuously with the telescopic crane in order to reach an even greater overall jib length exceeding the greatest jib length of the main jib 1, or even to allow work to be carried out behind the structure edges. This main jib extension 4 is designed as a lattice mast which typically has a truss pipe construction. In FIG. 1, the main jib 1 and the main jib extension 4 are located in a 0° position or basic position in which the longitudinal direction H of the main jib 1 and the longitudinal direction V of the main jib extension 4 are aligned with one another or extend in parallel with one another. A so-called luffing angle a of the main jib 1 relative to the superstructure 2 therefore amounts to 0° in the stored position. The luffing angle a describes the raising of the main jib 1 relative to the superstructure 2. In this basic position, the main jib extension 4 is spaced apart from a ground 10 and is therefore supported by the main jib 1 via the bolt connections on the main jib head 1*a*.

Such main jib extensions 4 are fundamentally constructed as modular design systems from individual main elements and can be fitted together depending on the required length or load capacity thereof. The individual main elements have dimensions suitable for transportation and in most cases are not carried along with the telescopic crane but are transported separately. When the spindle loads of the telescopic crane and the construction size of the main jib extension 4 allow, the main jib extension 4 can be carried along if required. This would then be located in a transport position laterally next to and in parallel with the main jib 1. The individual main elements are connected to one another by means of bolt connections at corresponding bolting points A, B, C and D to form the desired main jib extension 4. The attachment to the main jib head 1*a* can be effected using main elements or as a preassembled unit or units.

Figure 2A:
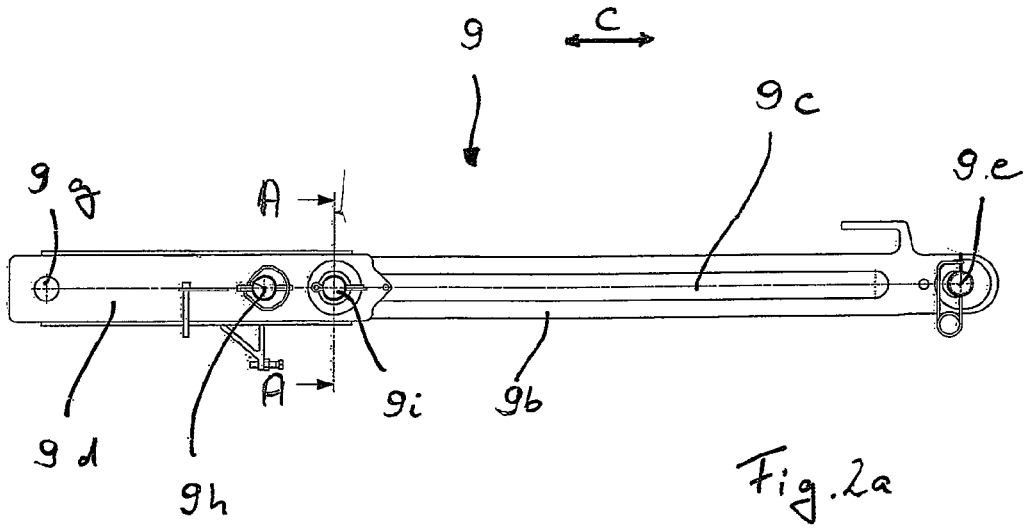

FIG. 2*a* shows a side view of an angling plate 9 in a maximally extended 40° position. The angling plate 9, by means of which a displacement path and therefore the angling angle b can be manually limited by means of a stop surface 9*a* (see FIG. 2*d*), consists substantially of a sliding plate 9*b* having a long hole-shaped guiding opening 5*c*, at which a guiding plate 9*d* can be guided in the longitudinal direction c of the sliding plate 9*b*. The sliding plate 9*b* is designed as an elongated flat profile having the stop opening 9*c* and extends substantially in parallel with the longitudinal direction V of the main jib extension 1. At an end facing the main jib head 1*a*, the sliding plate 9*b* has a bore 9*j* (see FIG. 2*d*), via which the sliding plate 9*b* is releasably fastened to the main jib head 2*a* at one of the bolting points E and F in each case by means of a connecting bolt 9*e*. The connecting bolt 9*e* is oriented with its longitudinal extension in parallel with the upper or lower rolling head spindle 12*a*, 12*b*. Slid onto the sliding plate 9*b* is the guiding plate 9*d* which for this purpose has a closed rectangular cross-section with a guiding opening 9*f* (see FIG. 2*b*), into which the sliding plate 9*b* is inserted and displaceably guided. The guiding plate 9*d* per se is releasably fastened to the main jib extension 4 at an end facing the main jib head 1*a* by means of in each case a further connecting bolt 9*i* at one of the bolting points G and H. The connecting bolt 9*i* is oriented with its longitudinal extension in parallel with the upper or lower rolling head spindle 12*a*, 12*b*. In this case, the connecting bolt 9*i* is also guided through the stop opening 9*c* of the sliding plate 9*b*. In order to limit a displacement of the guiding plate 9*d* on the sliding plate 9*b*, two stop bores 9*g* (see FIG. 2*d*) which are continuous and spaced apart from one another in the longitudinal direction of the guiding plate 9*d* are arranged in the side parts of the guiding plate 9*d*. A first one of the two stop bores 9*g* serves to limit the angling angle b to 20° and a second one of said stop bores serves to limit said angling angle to 40°. The stop bores 9*g* for 40° are accordingly arranged closer to the main jib head 1 in order to permit a larger displacement path. Depending upon the desired angling angle b, the respective stop bore 9*g* has a stop bolt 9*h* inserted therein which then extends through the two opposite stop bores 9*g* and the stop opening 9*c* located therebetween. In FIG. 2*a* the connecting bolt 9*h* is inserted into the second one of the two stop bores 9*g* which limits the angling angle b to 40°. The stop bolt 9*h* is guided next to the bolt 9*i* in the stop opening 9*c*. The bolt 9*i* would only come into contact with the opposite stop surface 9*a* of the stop opening 9*c* if no stop bolt 9*h* is inserted. The second one of the two stop bores 9*g* is free.

Figure 2B:
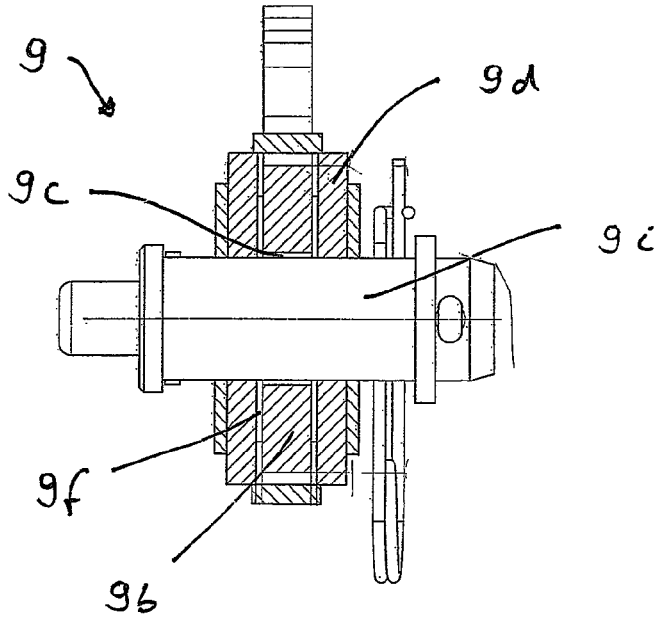

FIG. 2*b* illustrates a sectional view of FIG. 2*a* taken along section line A-A. It can be seen that the guiding plate 9*d* has a rectangular cross-section having a central guiding opening 9*f*, in which the sliding plate 9*b* with its stop opening 9*c* is guided.

Figure 2C:
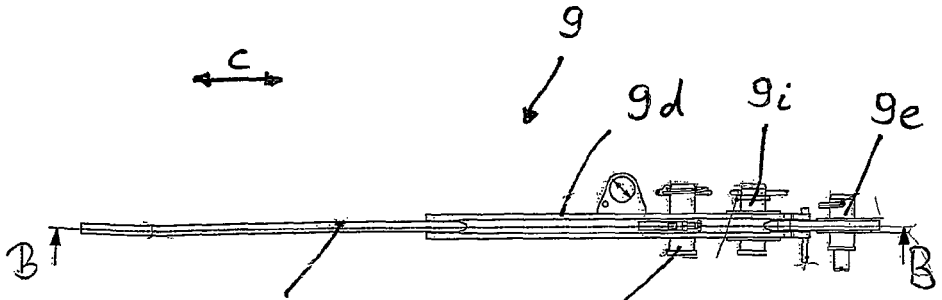

FIG. 2*c* also illustrates a plan view of an angling plate 9 in a transport position. In this transport position, the angling plate 9 is not attached to the main jib head 1*a* by means of the connecting bolt 9*e* and the sliding plate 9*b* is inserted in the direction of the main jib extension 4 into the guiding plate 9*d*. The connecting bolt 9*e* and the stop bolt 9*h* are inserted for storage purposes.

Figure 2D:
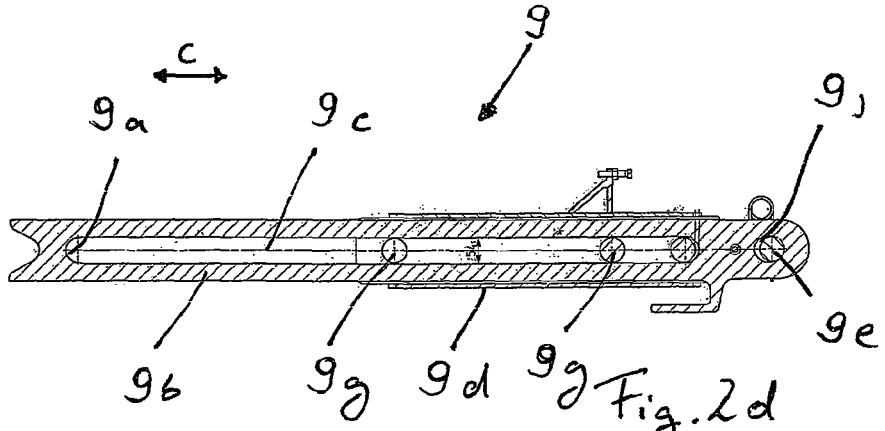

FIG. 2*d* shows a sectional view of FIG. 2*c* taken along section line B-B in FIG. 2*c*. This view clearly shows the stop opening 12*c* and the two stop bores.

Figure 2E:
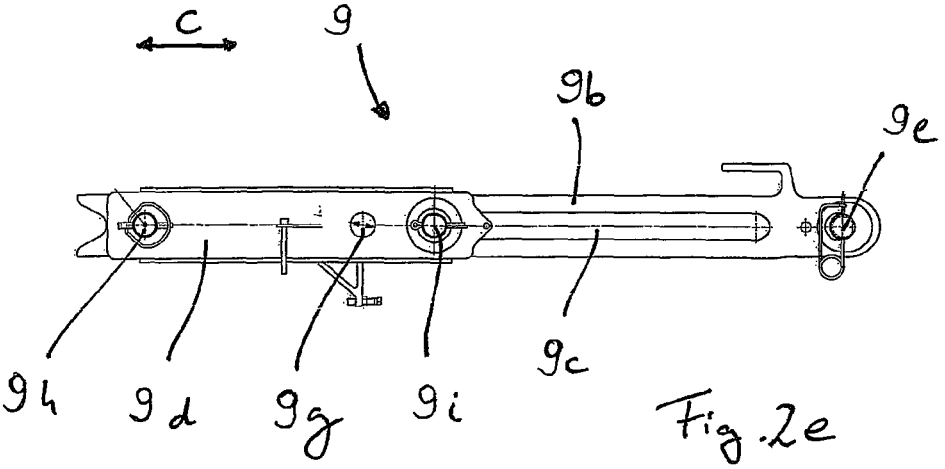

FIG. 2*e* illustrates a side view of an angling plate 9 which corresponds substantially to the angling plate 9 shown in FIG. 2*a*. Unlike in FIG. 2*a*, the angling plate 9 is not illustrated in the 40° position but instead is illustrated in the 20° position. Accordingly, the stop bolt 9*h* is inserted in the stop bore 9*g* remote from the main jib head 1*a*.

Figure 1:
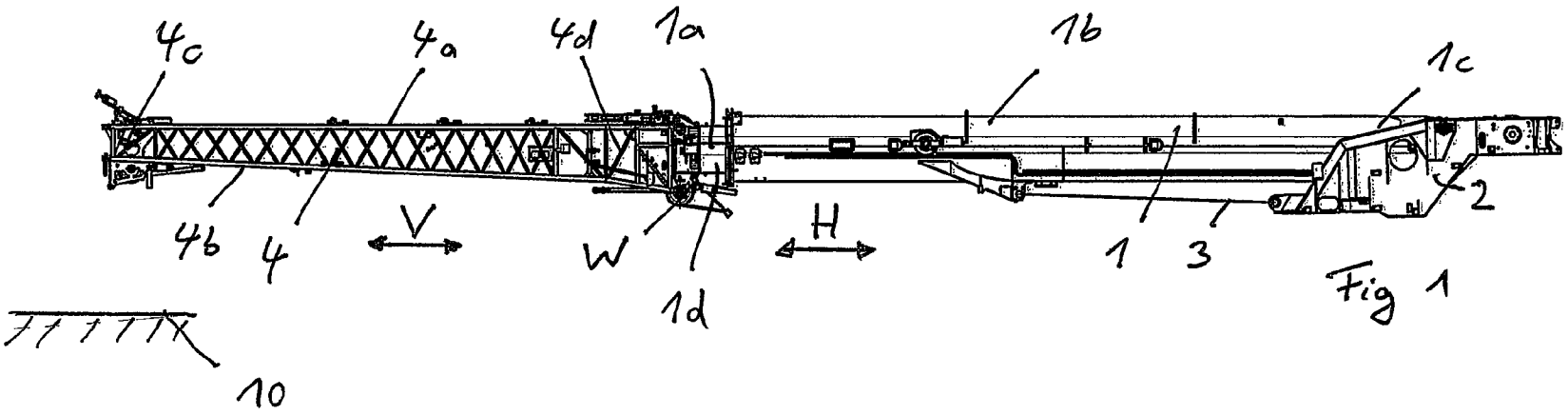
FIG. 1 shows a side view of a main jib 1 of a telescopic crane, not illustrated. Only a base frame 2 of a superstructure of the telescopic crane is illustrated. On the base frame 2, the main jib 1 with its main jib foot 1*c* is typically mounted so as to be able to pivot about a substantially horizontal axis and can be correspondingly erected and luffed by means of a luffing cylinder 3 which is indicated symbolically by a line and engages on the base frame and on the main jib 1.
Figure 3:
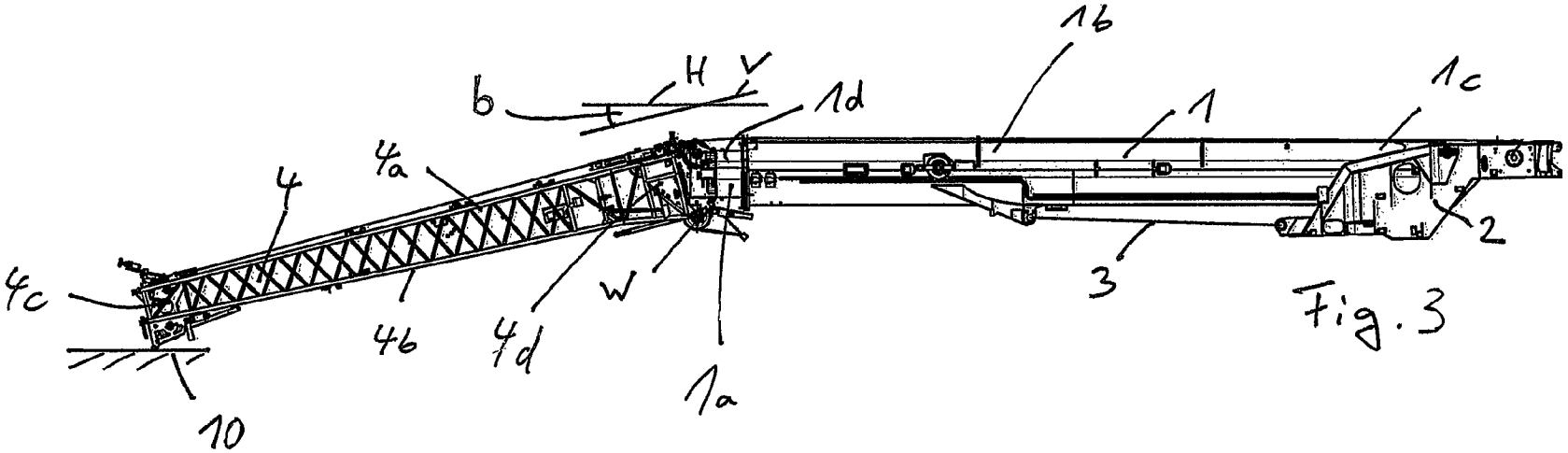

FIG. 3, which shows the main jib 1 according to FIG. 1 with the main jib extension 4 in a 20° position, shows the position described above in which the lowered tip 4*a* is supported on the ground 10.

Figure 4:
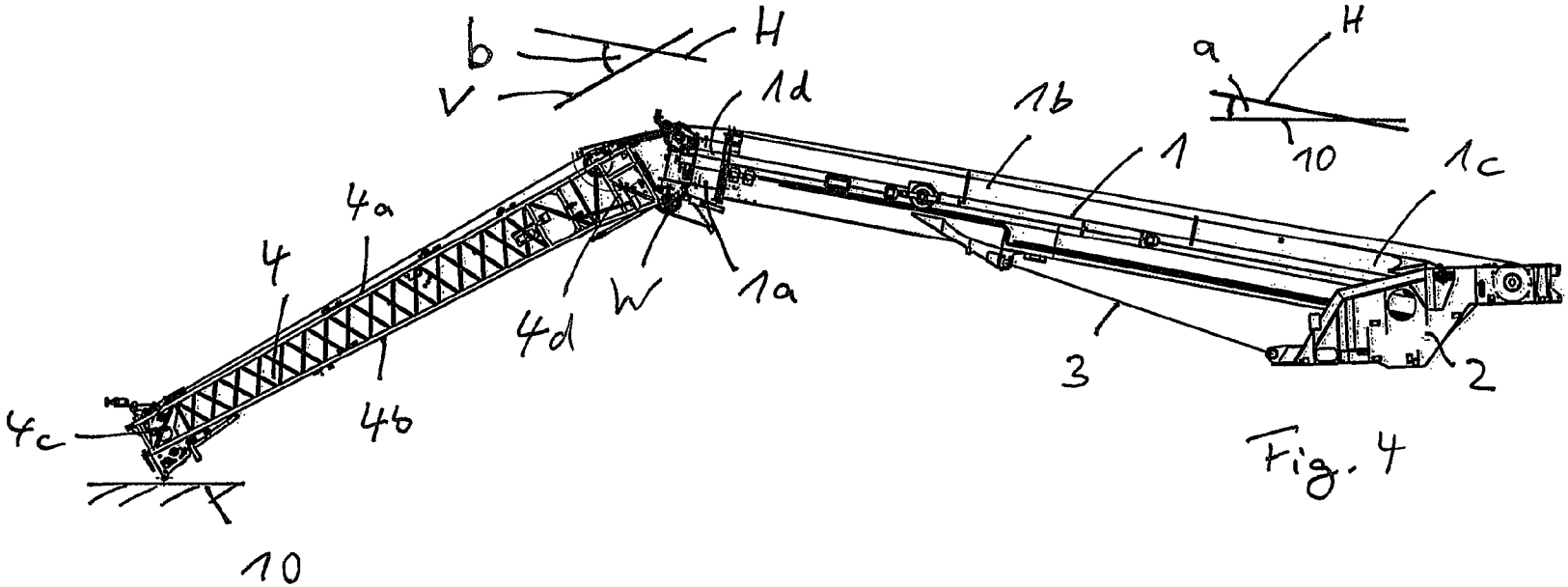

FIG. 4 shows the main jib 1 according to FIG. 3 with the main jib extension 1*a* in a 40° position, in which the lowered tip 4*a* is supported on the ground 10.

Figure 5:
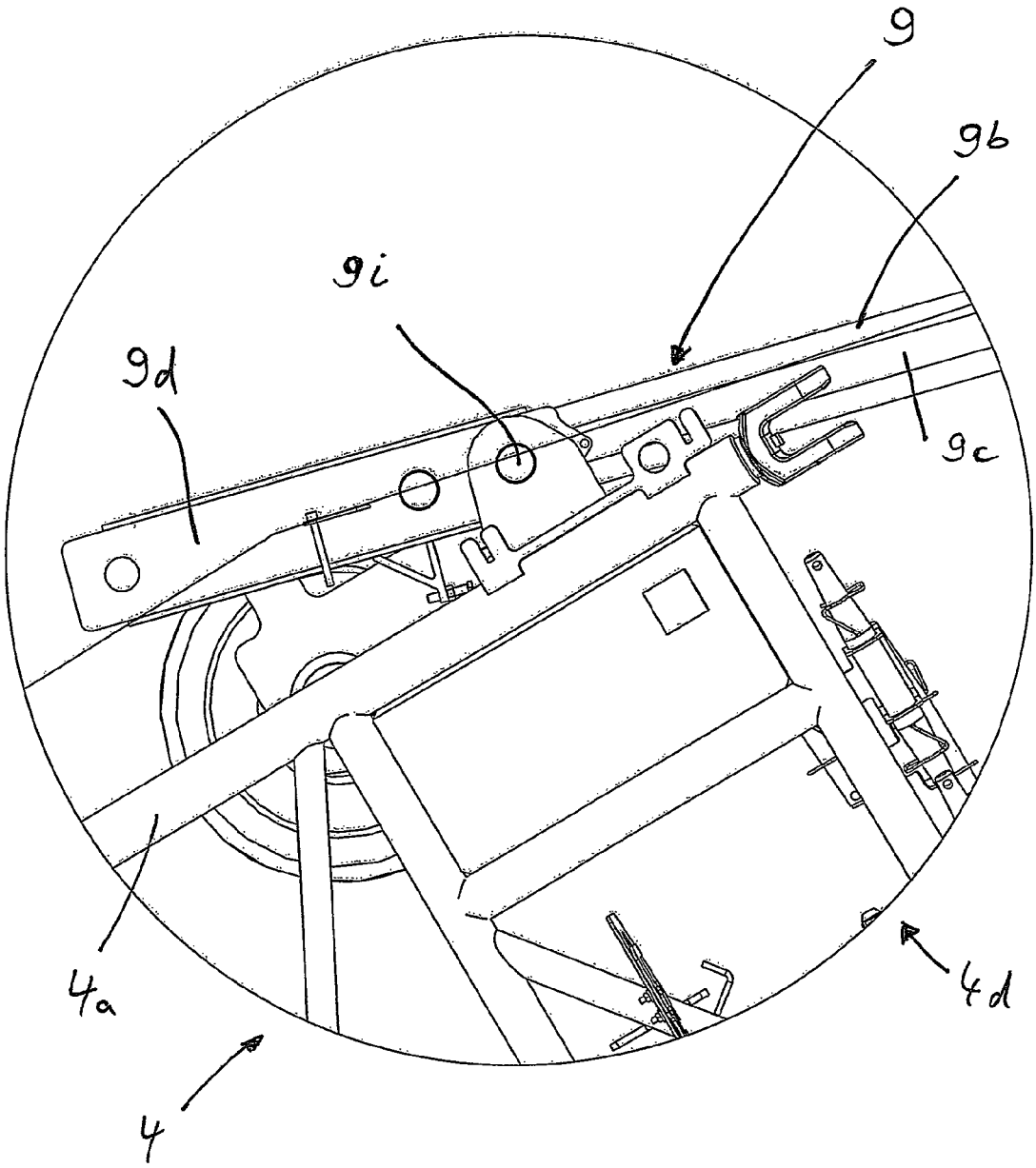

FIG. 5 is a detailed view of FIG. 4 from the region where the main jib extension 4 is coupled onto the main jib 1 with an angling plate 9 in a stop position with respect to a desired maximum angling position.

Figure 6:
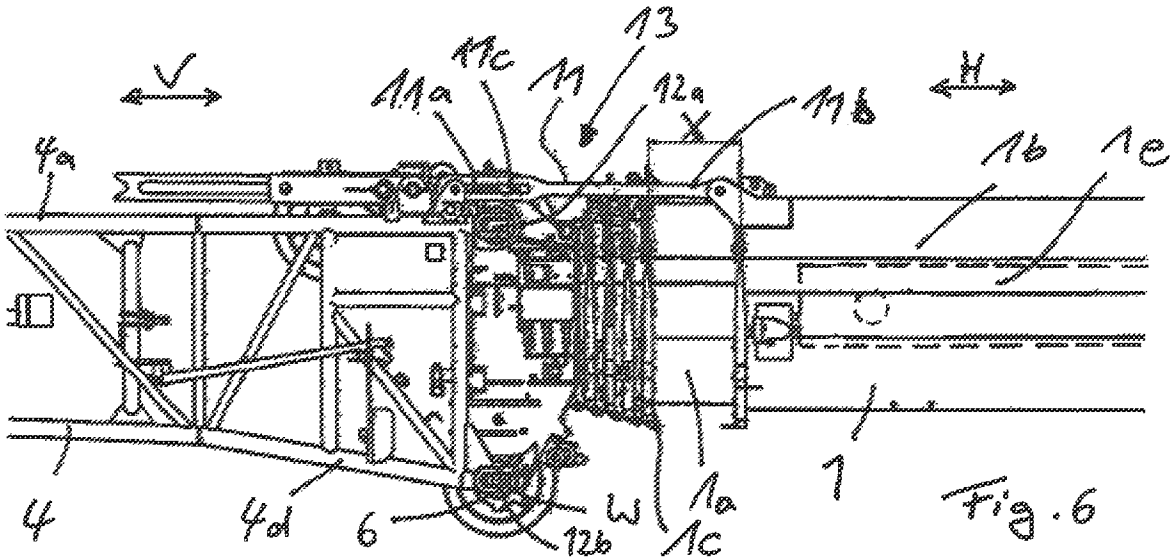

FIG. 6 shows a detailed view from the region where the main jib extension 4 is coupled onto the main jib 1 in the basic position. In this case, as an alternative to the previously described exemplified embodiment, the movement energy for angling the main jib extension 4 is provided by means of an angling drive 13 comprising a combination of a coupling rod 11 with a main jib 1 which can be telescoped by means of a telescopic cylinder 1*e*. The coupling rod 11 is oriented substantially in parallel with the longitudinal direction H of the main jib 1 and with the longitudinal direction V of the main jib extension 4 and is coupled to a first coupling rod end 11*a* in the region of the top chord 4*a* of the main jib extension 4 by means of a horizontally extending bolt. The opposite second coupling rod end 11*b* is likewise mounted on a basic box 15 of the main jib 1 by means of a horizontally extending bolt. The length of the coupling rod 11 is selected such that a telescopic section 1*c* which is extended with respect to the basic box 1*b* by the distance of an extension path x can then be retracted and extended such that the main jib extension 4 can be raised and lowered by an angling drive 13 so as to pivot about the luffing axis W against the effect of the gravitational force of the main jib extension 4. At one of the two coupling rod ends 11*a*, 11*b*, the coupling rod 11 can be provided with a long hole 11*c* in order to be able to connect more easily to the main jib 1 and the main jib extension 4 after the main jib 1 has been extended by the distance of the extension path x. Initial slight raising of the main jib extension 4 is necessary in order to relieve and then remove the upper bolts 6. Then, the telescopic section 1*c* is retracted and, seen relatively, the length of the coupling rod 11 is released which results in the main jib extension 4 being angled. After the tip 4*c* of the main jib extension 4 comes to rest on the ground 10, the coupling rod 11 is removed. In a further step, by luffing-up the main jib 2, the main jib extension 4 is angled further and the tip 4*c* of the main jib extension 4 slides therethrough over the ground 10 in the direction of the superstructure 2. By means of the luffing action, the main jib extension 4 is angled further to a luffing angle a, which is formed by the longitudinal direction H of the main jib 1 and the horizontal of the ground 10, for as long as until the angling plates 9 limit the angling in a preselected position. This position, in which the main jib extension 4 is located in a 40° position relative to the main jib 1, is illustrated in FIG. 4. At the point in time the angling movement is limited by the angling plates 9, the tip 4*c* is still just about in contact with the ground 10. During further luffing of the main jib 1, the main jib extension 4 then lifts from the ground 10 until the desired position for the main jib 1 with the main jib extension 4 arranged thereon in a 40° position with respect thereto is reached. In this position, the main jib extension 4 is held by its empty weight. However, corresponding locking in the angling plates 9 is not provided in the present embodiment. Preferably, two coupling rods 11 are provided which extend in parallel with one another on the right and left side of the main jib 1.

Figure 7:
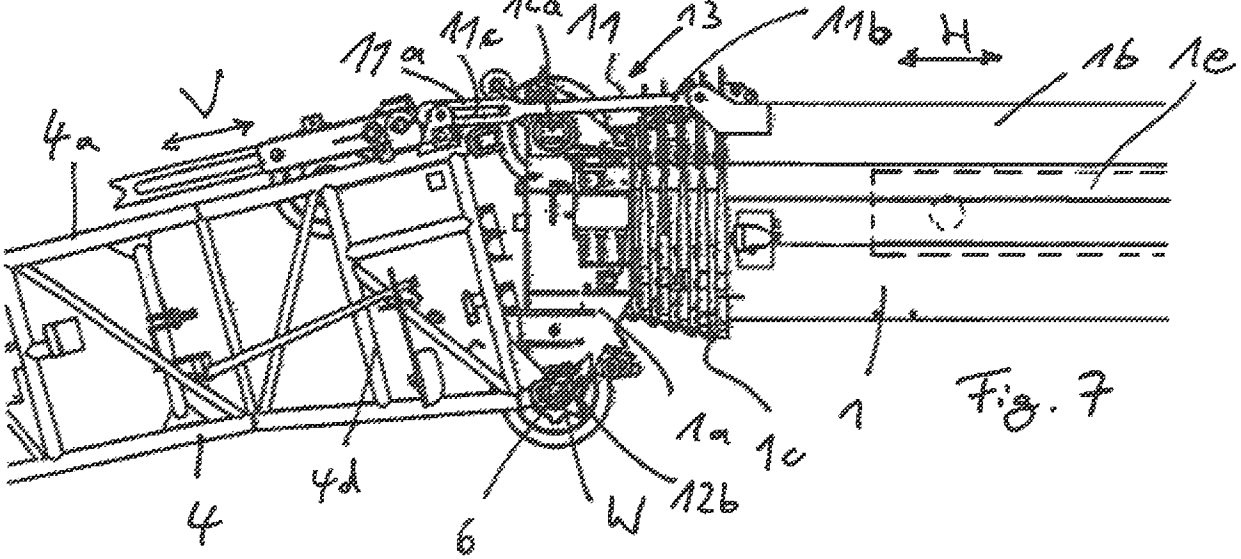

FIG. 7 shows a view as in FIG. 6 in another position of the main jib extension 4. It can be seen that the main jib extension 4 is already angled to such an extent that the tip 4*c* has reached the ground 10. The telescopic section 1*c* is retracted and the coupling rod 11 is relieved. If this position is reached, the next step is removal of the coupling rod 11 and further angling by the interaction of the erection of the main jib 1 and the angling plates 9.

Angling back the main jib extension 4 takes place in the reverse order.

Although in conjunction with the present exemplified embodiment, the main jib 1 is described as a telescopic jib and the main jib extension 4 is described as a lattice mast jib, the invention can also be applied to other embodiments of the main jib 1 and main jib extension 4. The main jib 1 can also be a lattice mast jib or a combination of a telescopic jib, lattice mast jib and/or box jib. For the main jib extension 4, lattice mast jibs or box jibs or combinations thereof are feasible.

The invention claimed is:

1. A mobile crane, said mobile crane comprising a luffably mounted telescopic main jib that is able to be raised via a luffing cylinder, and comprising a main jib extension releasably connected to a main jib head of the telescopic main jib via upper bolts and lower bolts, wherein the main jib extension, starting from a basic position after release of the upper bolts, is able to be angled about a luffing axis relative to the telescopic main jib by a coupling rod, wherein the coupling rod engages on the telescopic main jib and on a foot of the main jib extension, and wherein the main jib extension is angled relative to the telescopic main jib by movement of the coupling rod via extension and retraction of the telescopic main jib by a telescopic cylinder of the telescopic main jib.

2. The mobile crane as claimed in claim 1, wherein the coupling rod engages the main jib extension in the region of a top chord of the main jib extension.

3. The mobile crane as claimed in claim 2, wherein the coupling rod is designed such that the main jib extension can be raised and lowered so as to pivot about the luffing axis against the effect of the gravitational force of the main jib extension.

4. The mobile crane as claimed in claim 3, wherein the luffing axis is formed by a lower rolling head spindle.

5. The mobile crane as claimed in claim 4, wherein the coupling rod is fastened at a first coupling rod end to the top chord of the main jib extension and is fastened at a second coupling rod end to the main jib, wherein the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

6. The mobile crane as claimed in claim 2, wherein the luffing axis is formed by a lower rolling head spindle.

7. The mobile crane as claimed in claim 6, wherein the coupling rod is fastened at a first coupling rod end to the top chord of the main jib extension and is fastened at a second coupling rod end to the main jib, wherein the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

8. The mobile crane as claimed in claim 1, wherein the coupling rod is designed such that the main jib extension can be raised and lowered so as to pivot about the luffing axis against the effect of the gravitational force of the main jib extension.

9. The mobile crane as claimed in claim 8, wherein the luffing axis is formed by a lower rolling head spindle.

10. The mobile crane as claimed in claim 9, wherein the coupling rod is fastened at a first coupling rod end to a top chord of the main jib extension and is fastened at a second coupling rod end to the main jib, wherein the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

11. The mobile crane as claimed in claim 8, wherein the coupling rod is fastened at a first coupling rod end to a top chord of the main jib extension and is fastened at a second coupling rod end to the main jib, wherein the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

12. The mobile crane as claimed in claim 1, wherein the luffing axis is formed by a lower rolling head spindle.

13. The mobile crane as claimed in claim 12, wherein the coupling rod is fastened at a first coupling rod end to a top chord of the main jib extension and is fastened at a second coupling rod end to the main jib, wherein the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

14. The mobile crane as claimed in claim 1, wherein the coupling rod is fastened at a first coupling rod end to a top chord of the main jib extension and is fastened at a second coupling rod end to the main jib, wherein the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

15. A method for angling a main jib extension relative to a telescopic main jib of a mobile crane, wherein the main jib is luffably mounted on the mobile crane and can be raised via a luffing cylinder and the main jib extension is releasably connected to a main jib head of the main jib via upper bolts and lower bolts, said method comprising:

raising the main jib extension using a coupling rod relative to the main jib about a luffing axis starting from a basic position until the upper bolts are relieved, wherein the coupling rod is connected to a foot of the main jib extension and to the main jib, and wherein the main jib extension is angled via the coupling rod by extension and retraction of the telescopic main jib by a telescopic cylinder of the main jib;

removing the upper bolts;

inserting angling plates between the main jib head and a top chord of the main jib extension, wherein desired angling of the main jib extension with respect the main jib is limited by the angling plates, and wherein said inserting may be previously performed;

lowering the main jib extension via the coupling rod for as long as until a maximum angling position is reached or a tip of the main jib extension comes to rest on a ground; and disconnecting the coupling rod from providing movement energy to the main jib extension, and raising the main jib if the maximum angling position is not yet reached in order to angle the main jib extension until the desired angling is achieved.

16. The method of claim 15, wherein the coupling rod engages the main jib on the one hand and engages the main jib extension in the region of a top chord of the main jib extension on the other hand.

17. The method of claim 15, wherein the coupling rod is designed such that the main jib extension can be raised and lowered so as to pivot about the luffing axis against the effect of the gravitational force of the main jib extension.

18. The method of claim 15, wherein the luffing axis is formed by a lower rolling head spindle.

19. The method of claim 15, wherein the coupling rod is fastened at a first coupling rod end to the top chord of the main jib extension and is fastened at a second coupling rod end to the main jib, wherein the length of the coupling rod is selected such that a main jib previously extended by the distance of an extension path can subsequently be retracted and extended such that the main jib extension can be raised and lowered so as to pivot about the luffing axis against the effect of the gravitational force of the main jib extension.

* * * * *